US006152782A

United States Patent [19]

Volkert et al.

[11] Patent Number: 6,152,782

[45] Date of Patent: Nov. 28, 2000

[54] CONTACT PIN HAVING ANCHORING WINGS IN OPPOSITE DIRECTIONS, AND CONNECTOR ELEMENTS

[75] Inventors: Peter Volkert, Rednitzhembach; Willi Kobmann, Gräfenberg; Guntram May, Altdorf, all of Germany

[73] Assignee: Framatome Connectors International, Courbevoie, France

[21] Appl. No.: 09/006,110

[22] Filed: Jan. 13, 1998

[30] Foreign Application Priority Data

Jan. 13, 1997 [DE] Germany ..... 297 00 452 U

[51] Int. Cl.[7] ..... H01R 13/40; H01R 13/432

[52] U.S. Cl. ..... 439/733.1; 439/747

[58] Field of Search ..... 439/733.1, 869, 439/586, 747, 748, 746, 444

[56] References Cited

U.S. PATENT DOCUMENTS

| | | | |
|---|---|---|---|
| 4,707,050 | 11/1987 | Konnemann | 439/747 |
| 5,035,656 | 7/1991 | Patel | 439/753 |
| 5,064,389 | 11/1991 | Klein et al. | 439/651 |
| 5,147,227 | 9/1992 | Yurko | 439/733 |

FOREIGN PATENT DOCUMENTS

| | | | |
|---|---|---|---|
| 0647986 | 4/1995 | Germany | H01R 13/41 |

*Primary Examiner*—Brian Sircus
*Assistant Examiner*—Chandrika Prasad
*Attorney, Agent, or Firm*—Pollock, Vande Sande & Amernick, R.L.L.P.

[57] ABSTRACT

A wire type contact pin for an electrical connector has two pairs of lateral retaining wings on opposite sides of the pin. Each of these wings has a retaining face perpendicular to the longitudinal axis of the contact pin.

7 Claims, 3 Drawing Sheets

CONTACT PIN HAVING ANCHORING WINGS IN OPPOSITE DIRECTIONS, AND CONNECTOR ELEMENTS

FIELD OF THE INVENTION

The present invention relates to a contact pin which can be plugged into a receiving chamber of a connector body or can be inserted into a mold for the production of a connector body and subsequently be encapsulated by injection molding, in order to form a connector element in the form of a pin cup, male strip connector or the like, and also to a connector having such contact pins.

BACKGROUND OF THE INVENTION

In order to anchor pins of this type in the connector body, EP-A-0 647 986 discloses providing them with at least two pairs of lateral retaining wings situated opposite one another on the contact pin. The contact pins are press-fitted from the connection side into receiving chambers of a male strip connector or the like. In the process, top faces which diverge in the shape of a wedge on the retaining wings displace part of the material surrounding the chamber. After the passage of the retaining wings, some of the material returns to its initial position. In the process, it comes to lie on retaining faces at the rear side of the wings and in this way produces resistance against the pin being forced out counter to the press-fitting direction. This resistance can be improved only to a limited extent by the use of a stronger material, because the stronger the material is, the smaller is the portion which returns to the initial position and forms the support for the retaining faces. For this reason, pins can easily be forced out when the male strip connector is plugged together with a complementary female strip connector, which may lead to the failure of assemblies or equipment. The overall loadability could be improved if the wings could be enlarged. However, this is not practical for a number of reasons.

The larger the wings are, the higher, too, are the stresses which occur when the pins are press-fitted into the connector body. This can easily lead to the body buckling or even tearing, particularly in the case of multi-pole miniature connectors, which contain a large number of closely adjacent contact pins. Moreover, if the wings are produced by embossing the pin material, their size is limited by the material cross-section available for deformation.

The loadability of the known pin in the plugging direction frequently does not satisfy the relevant requirements.

SUMMARY OF THE INVENTION

The object of the invention is a contact pin for a connector which withstands high plugging force loading, yet causes only minimal stresses when it is press-fitted into a connector body.

It is additionally intended to specify a connector element having highly loadable contact pins.

During the press-fitting operation, the pair of wings oriented in the press-fitting direction acts in the known manner described above as protection against the pin being torn out.

The pair of wings oriented counter to the press-fitting direction pushes material of the connector body in front of it, compresses the material and, in this way, automatically produces for itself a stable support in the chamber.

In this way, the pin is well secured against displacement in the connector body in both directions. In particular, the loadability in the plugging direction is increased by a factor of 2–3 compared with the conventional pin. Since the wings may be smaller than in the prior art for the purpose of obtaining sufficient anchoring, the loading of the connector body by material which is laterally displaced during the press-fitting operation can be kept significantly lower, with the result that there is no longer a risk of the connector body being deformed or bursting.

The retaining wings of the first pair are preferably rotated about the longitudinal axis of the pin through approximately 90° with respect to the wings of the second pair.

The contact pins can be produced automatically from wire having a round or, preferably, square cross-section. The retaining wings can be produced by embossing.

BRIEF DESCRIPTION OF THE DRAWINGS

Further features and advantages of the invention emerge from the following description of an exemplary embodiment with reference to the attached drawings figures, in which.

DESCRIPTION OF PREFERRED EMBODIMENT

Figure 1:
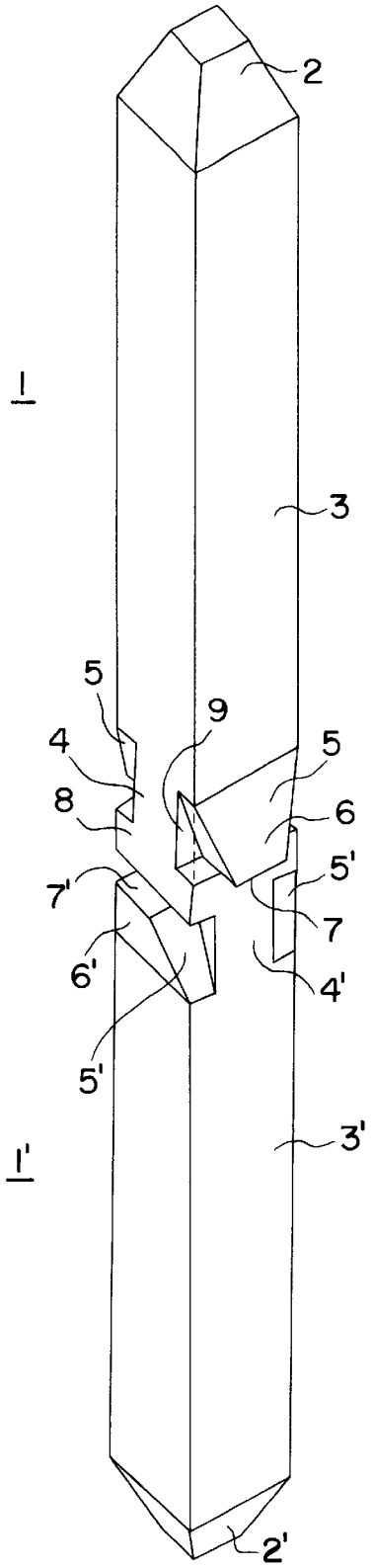
FIG. 1 is a perspective view of a first embodiment of a contact pin.

The contact pin shown in FIG. 1 and having a square cross-section has two halves, 1, 1', each having a tip 2, 2' in the shape of a truncated pyramid, a stem section 3, 3' having an essentially constant cross-section in the longitudinal direction of the pin, and a wing section 4, 4' having a pair of wings 5, 5' situated opposite one another. The wings 5 are oriented in the opposite direction to the wings 5'. The essentially trapezoidal top faces 6, 6' of the wings 5, 5' merge at their broad side with a surface of the plug-in section 1 and 1', respectively. The narrow side of the trapezium is respectively adjoined by a retaining face 7, 7', which is oriented essentially perpendicularly to the longitudinal axis L. The retaining wings projecting beyond the surface of the stem sections 3, 3' have been formed by material displaced, for example by an embossing tool, from the volume illustrated by dashed lines at 9. Lying between the mutually facing retaining faces 7, 7' is a section 8 whose cross-section corresponds to that of the stem sections 3, 3' and whose length can be defined depending on the length of the chamber of the connector body in which the pin is to be mounted.

Figure 2:
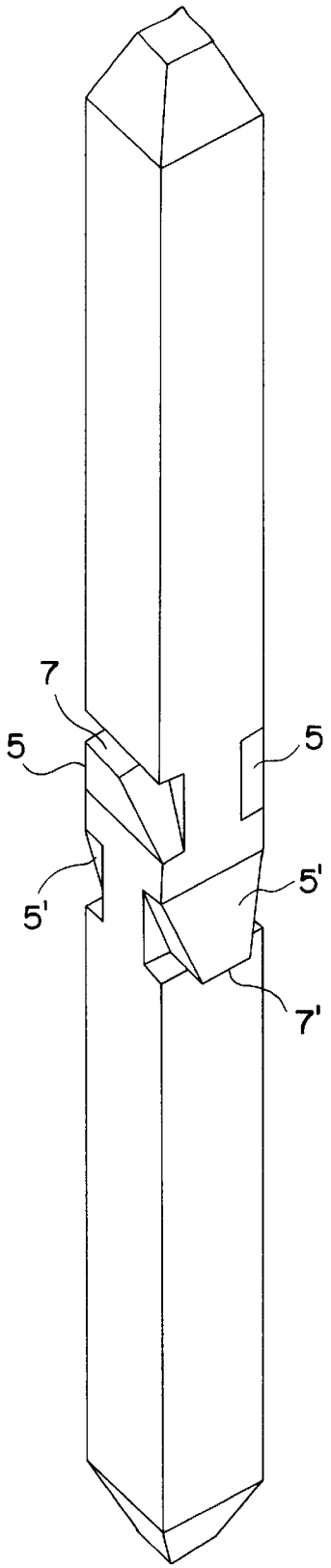
FIG. 2 is a perspective view of a second embodiment of the contact pin.

FIG. 2 shows a second embodiment of the contact pin according to the invention. This contact pin differs from that shown in FIG. 1 by virtue of the fact that the retaining faces 7, 7' of the pairs of wings 5, 5' are remote from one another. On account of the relatively large distance between the retaining faces 7, 7' of the two pairs of wings, this second embodiment affords greater protection against lateral tilting of the pins. A higher loadability in the direction of the pin axis can be achieved with the first embodiment since in this embodiment the retaining faces come to lie nearer to the center of the chamber 10 of the connector body.

Figure 3:
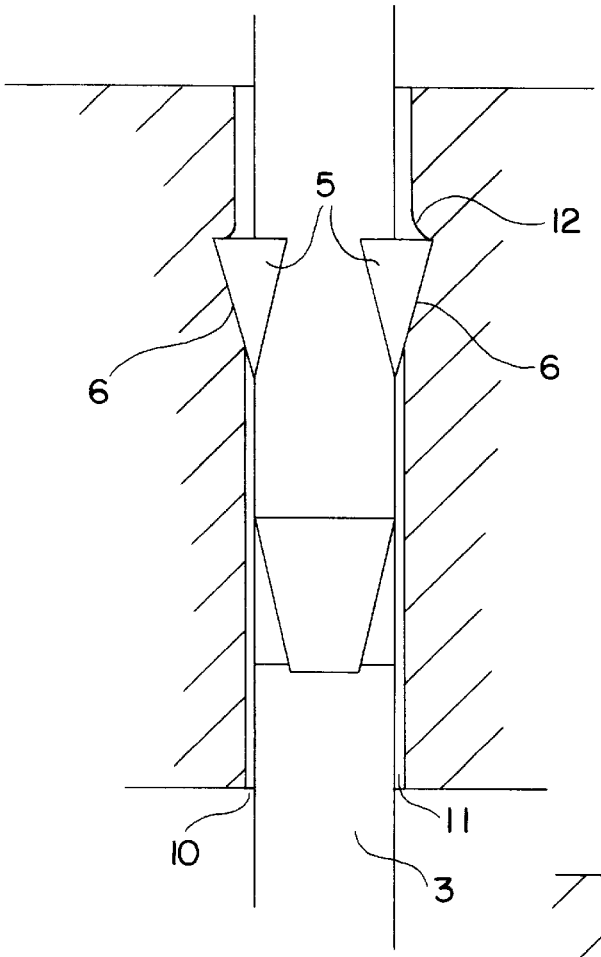
FIGS. 3 and 4 show a partial section through a connector body which illustrates the method of operation of the invention.
Figure 4:
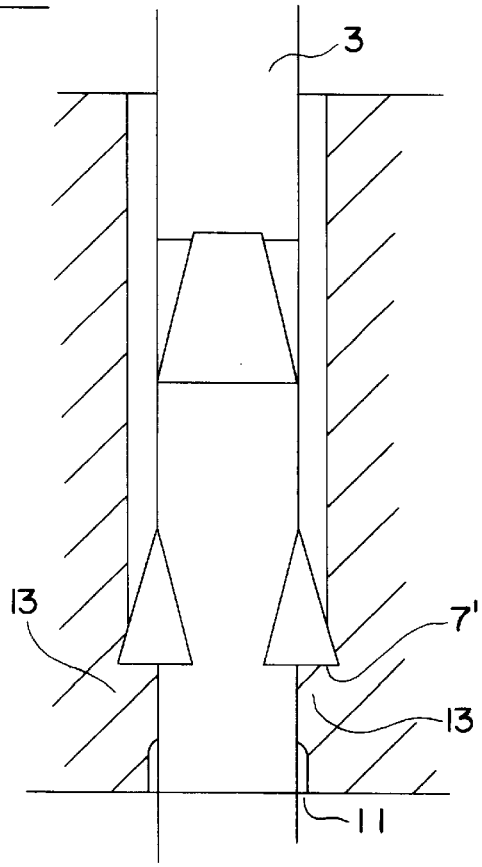

FIGS. 3 and 4 in each case show a side view of the middle region of a contact pin according to the second embodiment.

The method of operation of the contact pin will be explained with reference to these figures.

The pin shown in FIG. 3 has been plugged into the chamber 10 from the top. As is evident in the lower region of the figure, the cross-section of the stem section 3 is somewhat smaller than that of the chamber 10, with the result that a small clearance 11 exists between the wall of the chamber and the pin. When the wings 5 are pressed in, material is initially displaced laterally by the top faces 6 and then flows back, thereby producing an abutment 12 on the retaining faces which protects the pin against being drawn out.

FIG. 4 shows the same pin turned through 90°. It is evident that the retaining faces 7' have pushed material in front of themselves during the press-fitting operation. The clearance 1 has largely disappeared at these sides of the pin; instead the displaced, compressed material 13 presses both against the retaining faces 7' and against the walls of the pin and, as a result, further reinforces the anchoring of the pin.

Figure 5:
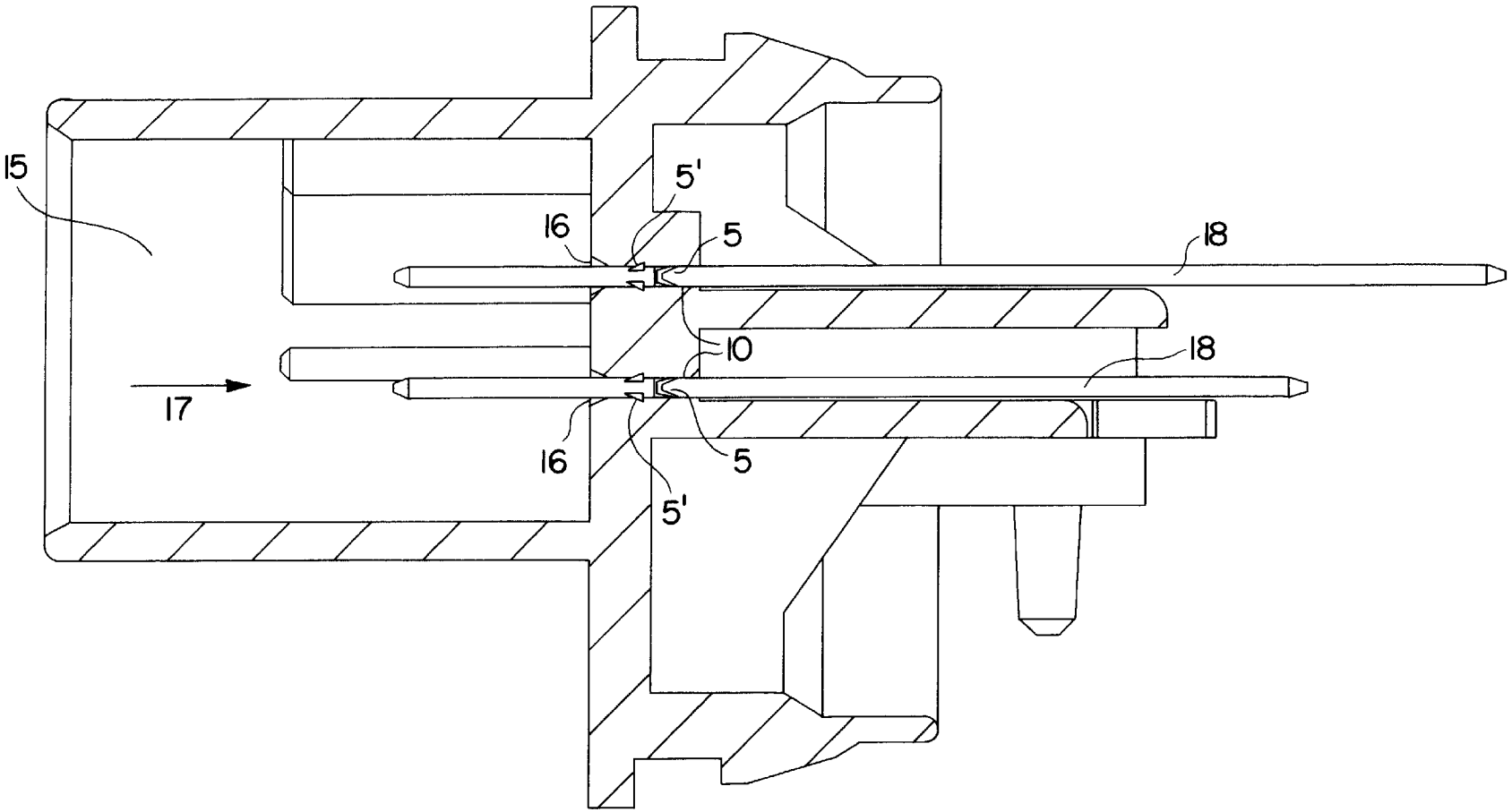
FIG. 5 shows a section through a male strip connector as an example of a connector element according to the invention.

FIG. 5 shows a male strip connector having contact pins according to the invention. The male strip connector has a plugging side 15 for plugging together with a female strip connector (not shown) and has chambers 10 which are provided with entry chamfers 16 and serve to receive the contact pins. The latter are press-fitted in the direction of the arrow 17, the pair of wings 5' oriented counter to the press-fitting direction 17 being oriented transversely with respect to the longitudinal direction of the male strip connector. The wings 5, 5' are preferably arranged, in the press-fitting direction, in the center of the chamber 10 or before that. In order to complete the male strip connector shown, the pins must still be bent away at right angles, following the contour of the male strip connector, in the regions designated by 18, as a result of which they are additionally protected against being drawn out.

What is claimed is:

1. A wire contact pin for a connector, having at least two pairs of generally trapezoidal lateral retaining wings constituted by embossments of and located on radially opposite sides of said contact pin, wherein a first pair of said retaining wings is arranged in a longitudinally opposite direction to a second pair of said retaining wings, wherein said retaining wings each have a broad side which merges with a plug-in section of said contact pin, and a retaining face which is essentially perpendicular to the longitudinal axis of the contact pin, and wherein the retaining faces of the wings of said first pair face those of said second pair with a predetermined spacing.

2. The contact pin according to claim 1, wherein the retaining wings of said first pair are rotated about the longitudinal axis of the pin through approximately 90° with respect to the wings of said second pair.

3. The contact pin according to claim 1, wherein the retaining wings are formed by embossing.

4. The contact pin according to claim 1, wherein said contact pin has a square cross-section.

5. The contact pin according to claim 1, wherein said contact pin has a round cross-section.

6. A connector element having at least one wire contact pin which is press-fitted into a chamber of a connector body, is held on supports and has at least one pair of generally trapezoidal retaining wings, wherein the supports are formed from connector material which is displaced counter to the orientation of the retaining wings when the contact pin is press-fitted.

7. A wire contact pin for a connector, having at least two pairs of generally trapezoidal lateral retaining wings constituted by embossments of and located on radially opposite sides of said contact pin, wherein a first pair of said retaining wings is arranged in a longitudinally opposite direction to a second pair of said retaining wings, wherein said retaining wings each have a broad side which merges with a plug-in section of said contact pin, and a retaining face which is essentially perpendicular to the longitudinal axis of the contact pin, and wherein the retaining faces of the wings of said first pair are remote from those of said second pair with a predetermined spacing.

* * * * *